US007702263B2

(12) United States Patent
Sato

(10) Patent No.: US 7,702,263 B2
(45) Date of Patent: Apr. 20, 2010

(54) TONER CARTRIDGE INCLUDING FEED OPENING AND RETURN OPENING AND IMAGE FORMING DEVICE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 588 days.

(21) Appl. No.: 11/681,491

(22) Filed: Mar. 2, 2007

(65) Prior Publication Data

US 2007/0212120 A1 Sep. 13, 2007

(30) Foreign Application Priority Data

Mar. 6, 2006 (JP) ..... 2006-058928

(51) Int. Cl.
*G03G 15/08* (2006.01)

(52) U.S. Cl. ..... 399/262; 399/263

(58) Field of Classification Search ..... 399/254, 399/258, 260, 262, 263
See application file for complete search history.

(56) References Cited

U.S. PATENT DOCUMENTS

| | | | | |
|---|---|---|---|---|
| 4,965,639 | A * | 10/1990 | Manno et al. | 399/262 |
| 5,508,794 | A | 4/1996 | Ikesue et al. | |
| 6,058,283 | A | 5/2000 | Okada | |
| 6,085,056 | A | 7/2000 | Okada | |
| 7,209,685 | B2 * | 4/2007 | Oyama et al. | 399/254 |

FOREIGN PATENT DOCUMENTS

| | | |
|---|---|---|
| JP | 7-134483 | 5/1995 |
| JP | 08-146746 A | 6/1996 |
| JP | 8-211720 | 8/1996 |
| JP | 08-305149 A | 11/1996 |
| JP | 9-319202 | 12/1997 |
| JP | 10-213957 | 8/1998 |

OTHER PUBLICATIONS

European Office Action mailed Jun. 5, 2009, European Patent Application No. EP07004172.8 [Note to Examiner: Refs. D1-D4 previously submitted with Extended EP Search Report in IDS filed Sep. 5, 2007].
Extended European Search Report dated Jul. 5, 2007 in Application No. EP07004172.8.

* cited by examiner

*Primary Examiner*—William J Royer
(74) *Attorney, Agent, or Firm*—Banner & Witcoff, Ltd

(57) ABSTRACT

In accordance with one or more aspects, a toner cartridge may be detachably attached to an image forming device. The toner cartridge may be provided with a cartridge case. This cartridge case may be provided with a toner chamber, a cartridge side feed opening for feeding a toner from the toner chamber to the outside of the cartridge case, and a cartridge side return opening from the outside of the cartridge case to the toner chamber. The cartridge side feed opening and the cartridge side return opening may be offset along a horizontal direction. A bottom surface of the toner chamber may slant downward from the cartridge side return opening to the cartridge side feed opening.

12 Claims, 5 Drawing Sheets

TONER CARTRIDGE INCLUDING FEED OPENING AND RETURN OPENING AND IMAGE FORMING DEVICE

CROSS-REFERENCE TO RELATED APPLICATION

This application claims priority to Japanese Patent Application No. 2006-58928, filed on Mar. 6, 2006, the contents of which are hereby incorporated by reference into the present application.

BACKGROUND

1. Field

The present invention relates to a toner cartridge that is detachably attached to an image forming device. In addition, the present invention also relates to a developing device and an image forming device.

2. Description of the Related Art

Devices which use toner to form images (e.g., laser printers, copy machines, facsimile devices, multi-function devices) are widely known. An image forming device of this type includes a developing device and a photoreceptor that supports an electrostatic latent image, and the like. The developing device includes a developing chamber and a developing roller.

A toner cartridge is detachable attached to the image forming device. The toner cartridge has a toner chamber that accommodates toner. When the toner cartridge is attached to the image forming device, the toner will be fed from the toner chamber to the developing chamber. The developing roller supports the toner that was fed to the developing chamber. The developing roller supplies the toner to the photoreceptor. In this way, the electrostatic latent image of the photoreceptor will be developed. By transferring the toner on the photoreceptor to a recording medium, an image will be formed on the recording medium.

The following technology is disclosed in Japanese Patent Application Publication No. 9-319202. In this technology, toner circulates between the image forming device (developing chamber) and the toner cartridge. A pair of openings (a cartridge side feed opening and a cartridge side return opening) that allow communication between the toner chamber and the exterior is formed in the toner cartridge. The cartridge side feed opening and the cartridge side return opening are offset along the horizontal direction. In addition, the bottom surface of the toner chamber is maintained at the same height between the cartridge side feed opening and cartridge side return opening. A pair of openings (a device side feed opening and a device side return opening) is formed in a side wall that defines the developing chamber. The device side feed opening and the device side return opening are offset in the horizontal direction.

When the toner cartridge is attached to the image forming device, the cartridge side feed opening and the device side feed opening face each other, and the cartridge side return opening and the device side return opening face each other. In this way, the toner chamber of the toner cartridge will communicate with the developing chamber of the image forming device. The toner of the toner chamber is fed to the developing chamber via the cartridge side feed opening and the device side feed opening. An auger that transports the toner inside the developing chamber from the device side feed opening to the device side return opening is provided in the developing device. The toner of the developing device will return to the toner chamber via the device side return opening and the cartridge side return opening. An agitator that transports the toner from the cartridge side return opening to the cartridge side feed opening is provided in the toner chamber. The toner transported to the cartridge side feed opening is fed again to the developing chamber from the cartridge side feed opening.

BRIEF SUMMARY

One or more aspects of the invention relate to smoothly circulating toner between a toner cartridge and an image forming device. Toner can be smoothly circulated between the toner cartridge and the image forming device, for instance, if the efficiency with which the toner is transported inside the toner cartridge could be improved.

Aspects of the present invention may improve the efficiency with which the toner is transported inside the toner cartridge.

With the aforementioned conventional toner cartridge, the bottom surface of the toner chamber is maintained at the same height between the cartridge side feed opening and the cartridge side return opening. Aspects of the present invention improve the efficiency with which the toner is transported in relation to the conventional construction.

A toner cartridge in accordance with one or more aspects of the invention may include a cartridge case. This cartridge case includes a toner chamber, a cartridge side feed opening for feeding a toner from the toner chamber to the outside of the cartridge case, and a cartridge side return opening for returning the toner from the outside of the cartridge case to the toner chamber. The cartridge side feed opening and the cartridge side return opening are offset along a horizontal direction. A bottom surface of the toner chamber slants downward from the cartridge side return opening to the cartridge side feed opening.

In one aspect as described herein, the above-described "the cartridge side feed opening and the cartridge side return opening are offset along a horizontal direction" and "a bottom surface of the toner chamber slants downward from the cartridge side return opening to the cartridge side feed opening" means a state when the toner cartridge is attached to an image forming device and development is being performed. In a state in which development is not being performed, the cartridge side feed opening and the cartridge side return opening do not necessarily have to be offset along the horizontal direction. In addition, in the state in which development is not being performed, the bottom surface of the toner chamber does not necessarily have to slant downward from the cartridge side return opening to the cartridge side feed opening.

According to this construction, because the bottom surface of the toner chamber slants downward from the cartridge side return opening and the cartridge side feed opening, the toner inside the toner chamber will be more smoothly transported to the cartridge side feed opening than when the bottom surface of the toner chamber is maintained at the same height. With this technology, the efficiency with which toner is transported inside the toner chamber can be improved compared to the conventional technology. When this toner cartridge is used, toner can be smoothly circulated between the toner cartridge and the image forming device.

DETAILED DESCRIPTION OF THE INVENTION

Figure 1:
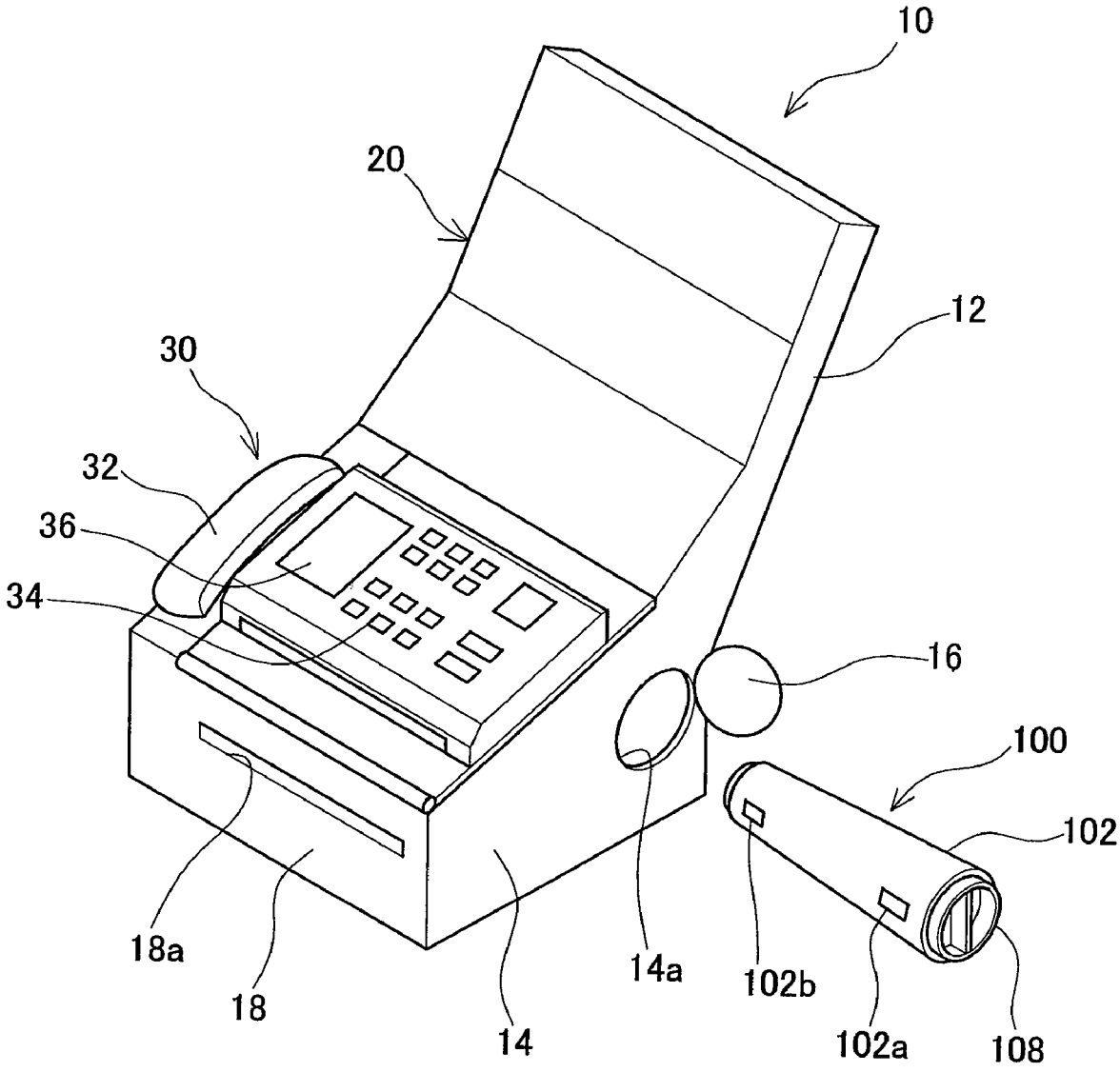
FIG. 1 shows an oblique view of a facsimile device.

Prior to describing the embodiments of the present invention, some of the characteristics of the technology disclosed in the embodiments will be listed below.

(Feature 1) The toner cartridge may have an interior member that defines a toner chamber. The exterior appearance of the interior member may have a substantially circular truncated conical shape corresponding to the shape of the toner chamber. The interior member may be housed in the interior of a cartridge case, and can rotate around an axis line with respect to the cartridge case. The interior member may have an interior feed opening and an interior return opening. When the interior feed opening faces a cartridge side feed opening, and the interior return opening faces a cartridge side return opening, the toner chamber will communicate with the outside of the cartridge case. By rotating the interior member with respect to the cartridge case, the cartridge side feed opening and the cartridge side return opening will simultaneously open/close.

(Feature 2) A transmission member may be exposed on the end surface of one side of the cartridge case (the side in which the radius of the toner chamber is small).

A handle member that a user can grasp may be provided on the end surface of the other side of the cartridge case (the side in which the radius of the toner chamber is large). The toner cartridge may be inserted into the image forming device from the end surface of the one side in a state in which a user is grasping the handle member.

(Feature 3) The handle member may not be fixed to the cartridge case, but may be fixed to the interior member. When the handle member is rotated, the interior member will rotate with respect to the cartridge case.

(Feature 4) An agitator of the toner cartridge may have a plurality of first rod members that are fixed to a rotation shaft and extend in a direction perpendicular to the rotation shaft. The tip of each first rod member may be connected by a second rod member. The agitator may not transfer force in the rotational shaft direction to the toner inside the toner storage chamber.

(Feature 5) The agitator adjacent to the cartridge side feed opening may have a construction in which films are bonded to the second rod member. Other portions of the rod member may not have film thereon.

The film of the agitator may transfer a large force in the rotational direction to the toner adjacent to the cartridge side feed opening. In this way, the toner adjacent to the cartridge side feed opening will be pushed into the cartridge side feed opening.

The agitator adjacent to the cartridge side return opening may transfer a small force in the rotational direction to the toner, because it does not have film. Because of this, toner returning from the cartridge side return opening will not be pushed back toward the developing chamber.

(Feature 6) The external appearance of the cartridge case may have a substantially columnar shape. This toner cartridge may be detachably attached to the image forming device in a state where the axis line of the cartridge case extends along the horizontal direction.

In this case, the space of the image forming device for housing the toner cartridge will also have a substantially columnar shape. The shape of the space will be simple.

(Feature 7) The image forming device of the embodiments is a facsimile device. However, the technology disclosed in the present specification can be applied to various devices other than facsimile devices, such as laser printers, copy machines, multi-function devices, etc.

First Embodiment

An embodiment will be described with reference to the drawings. FIG. 1 is an oblique view of a facsimile device 10 and a toner cartridge 100 of the present embodiment.

(Construction of the External Appearance of the Facsimile Device)

First, the construction of the external appearance of the facsimile device 10 will be briefly explained. The facsimile device 10 has a casing 12. A circular opening 14*a* is formed in the right side surface 14 of the casing 12. The casing 12 has a lid 16 that opens and closes the opening 14*a*. When the lid 16 is open, the toner cartridge 100 can be inserted into the casing 12 from the opening 14*a*. A slit 18*a* is formed in the front surface 18 of the casing 12. Print media that has been printed inside the casing 12 will be ejected to the exterior from the slit 18*a*.

The facsimile device 10 includes a paper supply device 20 and an operation portion 30. The paper supply device 20 can store a plurality of print media. The paper supply device 20 will supply the print media to a developing device 40 (to be described below). The construction of the paper supply device 20 will be described in detail below. The operation portion 30 has a telephone receiver 32, an operation panel 34, and a display 36. A user can use the telephone receiver 32 to make a telephone call. A telephone number, a facsimile number, or the like will be input by operating the operation panel 34. Various information will be displayed on the display 36.

(Construction of the Interior of the Casing)

Figure 2:
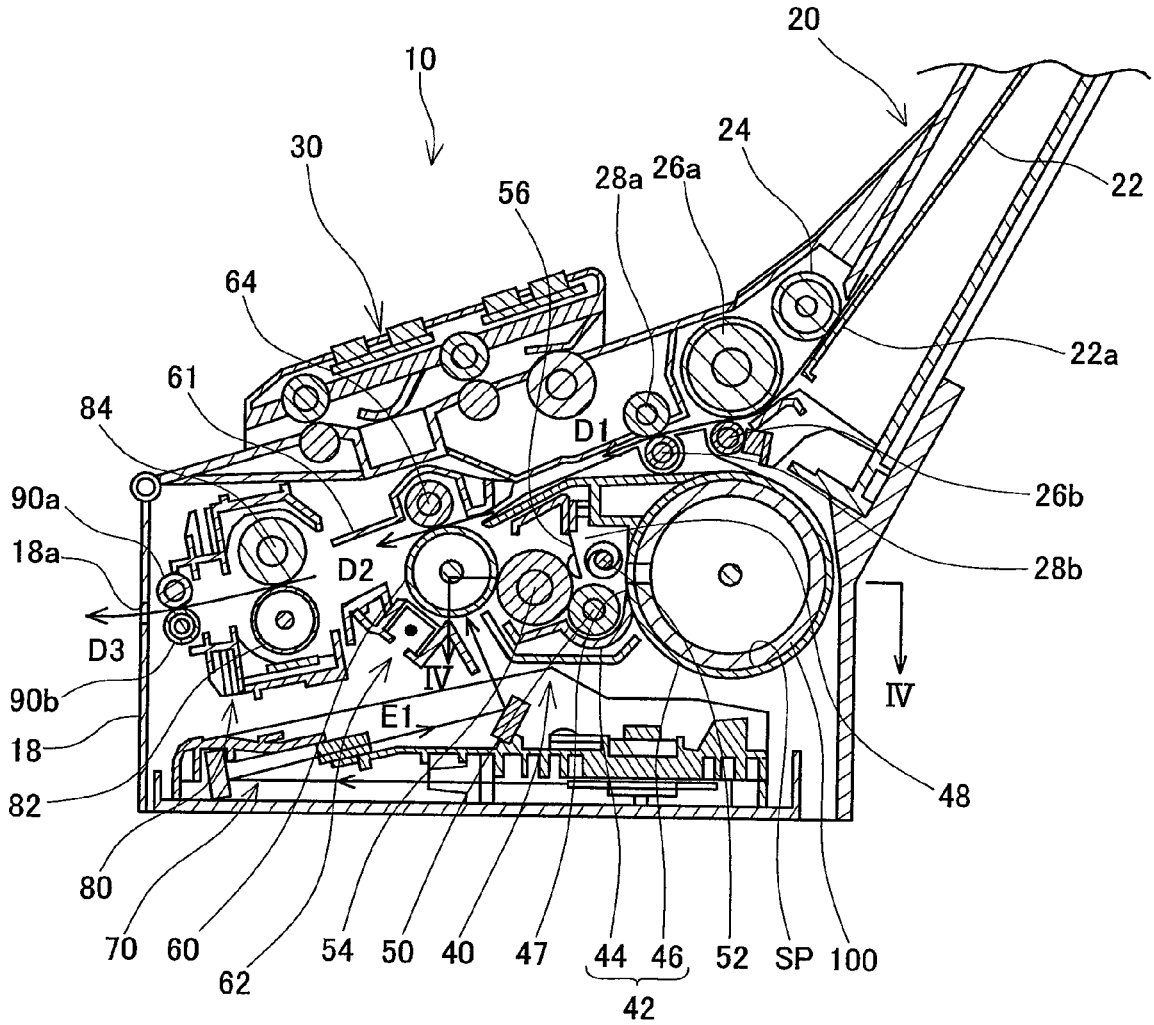
FIG. 2 shows a vertical cross-section of the facsimile device.

Next, the construction of the interior of the casing 12 will be described with reference to FIG. 2. FIG. 2 shows a vertical cross-section of the facsimile device 10. The facsimile device 10 includes the paper supply device 20 inside the casing 12, the developing device 40, a photoreceptor 60, a transfer roller 64, an exposure device 70, a toner fixing device 80, and the like. The construction of these devices 20, 40, etc. will be described in sequence below.

(Construction of the Paper Supply Device)

The paper supply device 20 has a bottom plate 22 and a plurality of rollers 24, 26*a*, 26*b*, 28*a*, and 28*b*. A plurality of print media not shown in the drawings is loaded onto the bottom plate 22. A front end portion 22*a* of the bottom plate 22 is urged toward the roller 24 by means of a mechanism not shown in the drawings. In this way, the uppermost print medium loaded on the bottom plate 22 can always be placed in contact with the roller 24. When the roller 24 rotates, the uppermost print medium loaded onto the bottom plate 22 will be sent along the direction of the rollers 26*a*, 26*b*. The print media sent by the roller 24 will be interposed between the rollers 26*a*, 26*b*. By rotating the rollers 26*a*, 26*b*, the print media will be sent further leftward. The print media sent by the rollers 26*a*, 26*b* will be interposed between the rollers 28*a*, 28*b*. By rotating the rollers 28*a*, 28*b*, the print media will be sent further leftward. The print media sent by the rollers

28*a*, 28*b* will be interposed between the photoreceptor 60 and the transfer roller 64 described below. The arrow D1 of FIG. 1 shows the direction of movement of the aforementioned print media.

(Construction of the Developing Device)

The developing device 40 has a case 42, a supply roller 50, an auger 52, a developing roller 54, a thickness regulating member 56, and the like.

(Construction of the Case)

The case 42 has a first case 44 that is formed on the left side, and a second case 46 that is formed on the right side. The first case 44 and the second case 46 are formed to be integral with each other. The first case 44 has a substantially box shape. The first case 44 defines a developing chamber 48. The first case 44 rotatably supports the supply roller 50, the auger 52, and the developing roller 54. The external appearance of the second case 46 has a substantially circular truncated conical shape having an axis line that extends in a perpendicular direction with respect to the plane of FIG. 2. The second case 46 defines a space SP for housing the toner cartridge 100. The space SP has a substantially circular truncated conical shape that corresponds to the external shape of the second case 46. In FIG. 2, the toner cartridge 100 is housed in the space SP. In FIG. 2, the construction of the toner cartridge 100 is shown in simplified form.

The second case 46 has a side wall 47 that divides the space SP from the developing chamber 48. A pair of side wall openings 46*a*, 46*b* (these reference numbers are omitted in FIG. 2 but shown in FIG. 4) that communicate with the space SP and the developing chamber 48 are formed in the side wall 47. The side wall feed opening 46*a* and the side wall return opening 46*b* are offset in the direction perpendicular to the plane of FIG. 2. The side wall feed opening 46*a* is located on the near side in the direction perpendicular to the plane of FIG. 2. The side wall return opening 46*b* is located on the far side in the direction perpendicular to the plane of FIG. 2.

(Construction of the Supply Roller)

The supply roller 50 is rotatably supported on the first case 44. The supply roller 50 is housed inside the developing chamber 48, and supports toner inside the developing chamber 48. The supply roller 50 will rotate in the clockwise direction. The supply roller 50 will supply the toner to the developing roller 54.

(Construction of the Auger)

The auger 52 is rotatably supported on the first case 44. The auger 42 is housed inside the developing chamber 48 above the supply roller 50. The auger 52 will rotate in the counterclockwise direction. The auger 52 will transport the toner inside the developing chamber 48 from the side wall feed opening 46*a* to the side wall return opening 46*b* by rotating. The detailed construction of the auger 52 will be described later by employing FIG. 4.

(Construction of the Developing Roller)

The developing roller 54 is rotatably supported on the first case 44. The developing roller 54 is in contact with the supply roller 50 on the left side of the supply roller 50. The developing roller 54 defines the developing chamber 48. The developing roller 54 will rotate in the clockwise direction. The developing roller 54 will support the toner supplied from the supply roller 50.

(Construction of the Thickness Regulating Member)

The thickness regulating member 56 is fixed to the first case 44. The thickness regulating member 56 defines the developing chamber 48. The thickness regulating member 56 is in contact with the developing roller 54. The thickness regulating member 56 extends in the direction perpendicular to the plane of FIG. 2, and is in contact with approximately the entire region of the developing roller 54. The thickness regulating member 56 regulates (adjusts) the thickness of the toner layer on the developing roller 54.

The overall construction of the developing device 40 was simply described. Next, the construction of the photoreceptor 60 and periphery thereof will be described.

(Construction of the Photoreceptor and the Periphery thereof)

The photoreceptor 60 is housed inside a frame 61. The frame 61 is fixed to the casing 12. The photoreceptor 60 is in contact with the developing roller 54 on the left side of the developing roller 54. The photoreceptor 60 will rotate in the counterclockwise direction. A scorotron electrostatic charger 62 is located to the left of and below the photoreceptor 60. The scorotron electrostatic charger 62 places a positive electrostatic charge on the surface of the photoreceptor 60 by means of a corona discharge. The surface of the photoreceptor 60 on which a positive electrostatic charge is placed will be exposed by laser light generated from the exposure device 70 described below. In this way, predetermined portions of the surface of the photoreceptor 60 will be exposed by the light. The portions exposed by the light depend upon the content to be printed (the content of received FAX communications). The electric potential of the exposed portions of the photoreceptor 60 will fall. In this way, an electrostatic latent image based on the content to be printed will be formed on the photoreceptor 60.

By rotating the developing roller 54 and the photoreceptor 60 while in contact with each other, the toner supported on the developing roller 54 will adhere to the exposed portions of the photoreceptor 60. The toner will not adhere to the non-exposed portions of the photoreceptor 60. In this way, the electrostatic latent image formed on the photoreceptor 60 will be made visible. In other words, the electrostatic latent image on the photoreceptor 60 will be developed by the developing device 40.

(Construction of the Transfer Roller)

The transfer roller 64 is rotatably supported on the frame 61. The transfer roller 64 is in contact with the upper surface of the photoreceptor 60. The transfer roller 64 is constructed from an elastic material having conductivity. The transfer roller 64 will rotate in the clockwise direction. The transfer roller 64 is connected to a voltage supply circuit not shown in the drawings. When a print medium passes between the photoreceptor 60 and the transfer roller 64 (when in the state shown by arrow D2), a bias will be applied from the voltage supply circuit to the transfer roller 64. The toner will be transferred to the print medium from the photoreceptor 60 due to the difference in electric potential between the photoreceptor 60 and the transfer roller 64.

(Construction of the Exposure Device)

The exposure device 70 is located below the developing device 40. The exposure device 70 generates laser light. The laser light that is generated will proceed in the direction of arrow E1 in FIG. 2. The laser light will arrive at the photoreceptor 60. In this way, the photoreceptor 60 will be exposed.

(Construction of the Toner Fixing Device)

The toner fixing device 80 is located to the left of the photoreceptor 60 and the transfer roller 64. The toner fixing device 80 has a heat roller 82 and a pressure roller 84. The heat roller 82 has a halogen lamp, and generates heat. The heat roller 82 will rotate in the counterclockwise direction. The pressure roller 84 will be urged toward the heat roller 82 by means of a mechanism not shown in the drawings. The pressure roller 84 will be driven and rotated in the clockwise direction when the heat roller 82 rotates in the counterclockwise direction. Print media that passes between the photoreceptor 60 and the transfer roller 64 will be interposed between the heat roller 82 and the pressure roller 84. At this point, the heat roller 82 will heat the print media. In this way, the toner transferred to the print media will be fixed by means of heat.

(Construction of the Paper Discharge Mechanism)

A pair of rollers 90*a*, 90*b* is located to the left of the toner fixing device 80. The print media that passes through the toner fixing device 80 will be interposed between the rollers 90*a*, 90*b*. The print media will be sent leftward by the pair of rollers 90*a*, 90*b* (arrow D3). The print media will pass through the slit 18*a* and sent out to the exterior of the casing 12. In this way, the print media will be ejected.

The construction of the facsimile device 10 was simply described. In addition, the process of printing on print media by means of the facsimile device 10 was simply described. Next, the construction of the toner cartridge 100 will be described.

(Construction of the Toner Cartridge)

Figure 3:
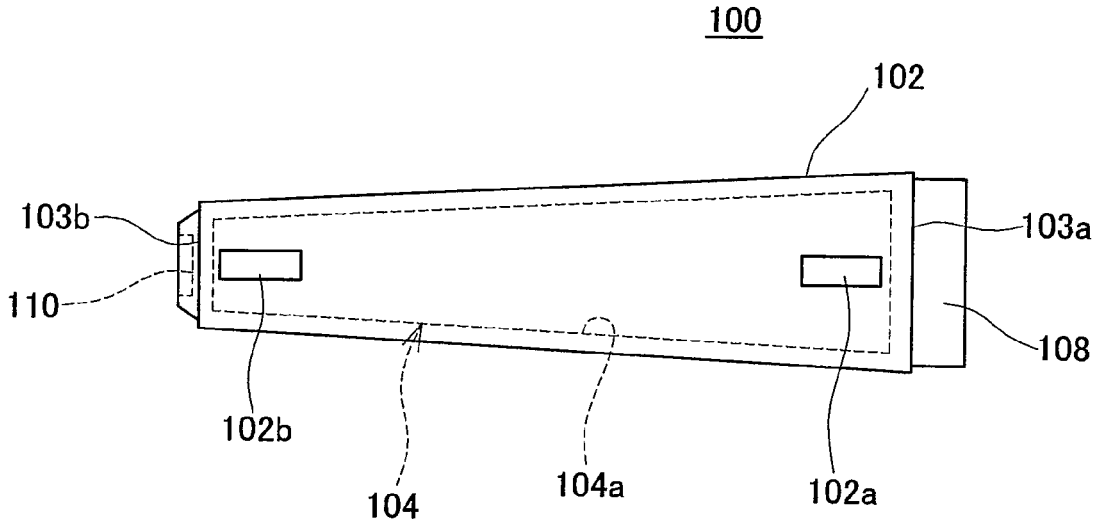
FIG. 3 shows a front view of a toner cartridge.

FIG. 3 shows a front view of the toner cartridge 100. The toner cartridge 100 accommodates toner.

(Description of the Toner)

The toner stored in the toner cartridge 100 is a non-magnetic one component type toner having a positive electrostatic charge. For example, a polymer toner will be used that was obtained by co-polymerizing a styrene monomer or an acryl monomer by means of suspension polymerization. Acrylic monomers that can be used include acrylic acid, acryl (C1-C4) acrylate, alkyl (C1-C4) methacrylate, and the like. This polymer toner has a substantially spherical shape and has superior fluidity. A colorant and a wax are combined with the polymer toner. In addition, additives such as silica and the like are added in order to improve fluidity.

(Construction of the External Appearance of the Toner Cartridge)

The toner cartridge 100 includes a case 102. The external appearance of the case 102 has a substantially circular truncated conical shape. In the state shown in FIG. 3, the axis line of the case 102 extends in the horizontal direction. A pair of openings 102*a*, 102*b* of the same shape is formed in the conical surface of the case 102. The case feed opening 102*a* and the case return opening 102*b* are offset along the horizontal direction. The case feed opening 102*a* is located adjacent to the end surface 103*a* on the thick end of the case 102. The case return opening 102*b* is located adjacent to the end surface 103*b* on the tapered end of the case 102. The case feed opening 102*a* and the case return opening 102*b* are located at the same height (the same location in the vertical direction of FIG. 3).

A toner chamber 104 that accommodates toner is formed in the interior of the case 102. The toner chamber 104 has a substantially circular truncated conical shape that corresponds (resembles) the external shape of the case 102. Thus, the bottom surface 104*a* of the toner chamber 104 slants downward to the right in FIG. 3. In other words, the bottom surface 104*a* slants downward at a constant gradient from the case return opening 102*b* to the case feed opening 102*a*.

The end surface 103*a* of the case 102 is open. A handle member 108 is inserted into this opening. The shape of the handle member 108 is shown well in FIG. 1. How the handle member 108 is related to the case 102 will be described below. A transmitting member 110 that will be described below is inserted into the end surface 103*b* of the case 102. How the transmitting member 110 is related to the case 102 will be described below.

The toner cartridge 100 will be detachably attached to the facsimile device 10 in a state in which the bottom surface 104*a* of the toner chamber 104 is maintained as a bottom surface. In other words, as shown in FIG. 3, the toner cartridge 100 is attached to the facsimile device 10 and used in a state in which the bottom surface 104*a* is slanted downward from the case return opening 102*b* to the case feed opening 102*a*.

(Construction of the Interior of the Toner Cartridge)

Figure 4:
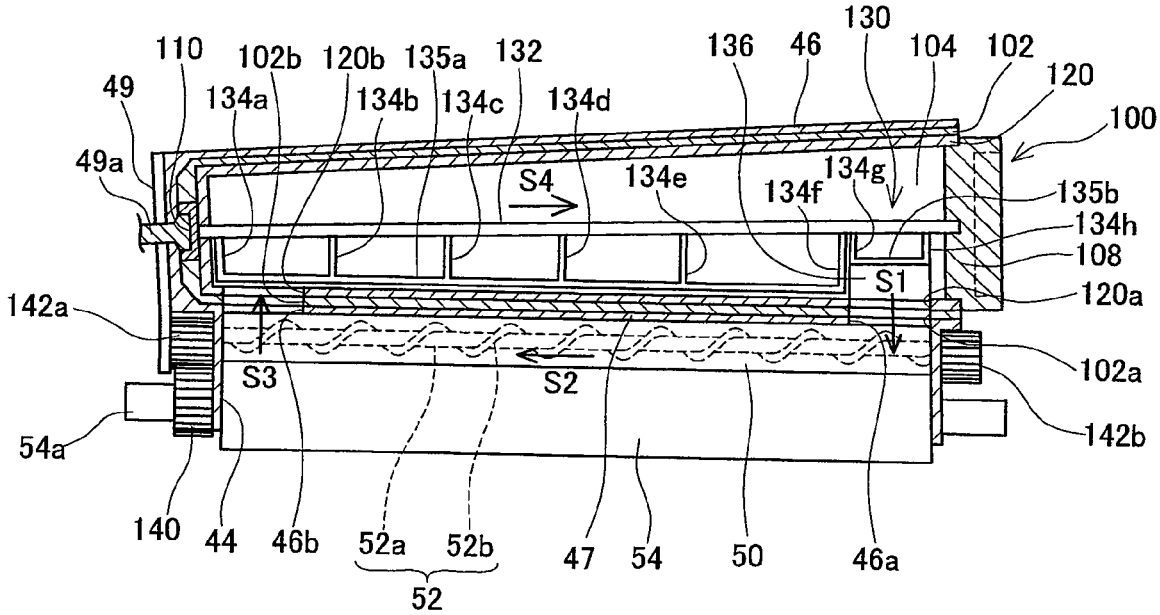
FIG. 4 shows a cross-section along line IV-IV of FIG. 2.

The construction of the interior of the toner cartridge 100 will be described with reference to FIG. 4. FIG. 4 shows a cross-section along line IV-IV of FIG. 2. However, in FIG. 4, the casing 12 is not illustrated, and the developing roller 54 and each gear are not shown in the cross section. In addition, in FIG. 4, the auger 52 not seen in cross section is shown with a broken line. In the state shown in FIG. 4, the toner cartridge 100 is housed in the second case 46.

(Construction of the Interior Member)

The toner cartridge 100 has an interior member 120. The interior member 120 is housed inside the case 102. The toner chamber 104 is formed in the interior of the interior member 120. The interior member 120 defines the toner chamber 104. The external appearance of the interior member 120 has a substantially circular truncated conical shape that corresponds (resembles) to the external shape of the case 102. The axis line of the interior member 120 (the axis line of the toner chamber 104) matches the axis line of the case 102. The interior member 120 is capable of rotating around the axis line with respect to the case 102.

The interior member 120 has a pair of interior openings 120*a*, 120*b*. The interior feed opening 120*a* and the interior return opening 120*b* are offset from left to right (i.e., the horizontal direction) in FIG. 4. The interior feed opening 120*a* is located adjacent to the end surface 103*a* on the thick end of the case 102 (see FIG. 3). The interior return opening 120*b* is located adjacent to the end surface 103*b* on the tapered end of the case 102 (see FIG. 3). The interior feed opening 120*a* and the interior return opening 120*b* are located at the same height (the same location in the vertical direction of FIG. 3). The interior feed opening 120*a* has the same shape as the case feed opening 102*a*. The interior return opening 120*b* has the same shape as the case return opening 102*b*. In other words, the interior feed opening 120*a* and the interior return opening 120*b* have the same shape. In the state shown in FIG. 4, the case feed opening 102*a* and the interior feed opening 120*a* face each other. In addition, the case return opening 102*b* and the interior return opening 120*b* face each other. In this state, the toner chamber 104 communicates with the exterior of the case 102.

The handle member 108 is fixed to the interior member 120. A user can rotate the handle member 108. When the handle member 108 rotates, the interior member 120 will also rotate together therewith. When the interior member 120 rotates, the positional relationship between the interior feed opening 120*a* and the case feed opening 102*a* will change. For example, when the interior member 120 is rotated from the state shown in FIG. 4, the state will switch from one in which the interior feed opening 120*a* faces the case feed opening 102*a* (facing state) to one in which the interior feed opening 120*a* does not face the case feed opening 102*a* (non-facing state). On the other hand, when the interior member 120 is rotated when the interior feed opening 120*a* is in the non-facing state, the interior member 120 can be switched from the non-facing state to the facing state. In the present embodiment, by rotating the interior member 120, the positional relationship between the interior feed opening 120*a* and the case feed opening 102*a* can be switched between the facing state and the non-facing state. Likewise, in the present embodiment, by rotating the interior member 120, the positional relationship between the interior return opening 120*b* and the case return opening 102*b* can be switched between the facing state and the non-facing state.

(Construction of the Agitator)

The toner cartridge 100 includes an agitator 130. The agitator 130 is housed inside the toner chamber 104. The agitator 130 has a rotation shaft 132, a plurality of first rod members 134*a* to 134*h*, a plurality of second rod members 135*a*, 135*b*, and a film 136. The rotation shaft 132 extends in the same direction as the axis line of the toner chamber 104. The left end portion of the rotation shaft 132 is rotatably supported on the interior member 120. The right end portion of the rotation shaft 132 is rotatably supported on the handle member 108. Even if the rotation shaft 132 rotates, the interior member 120 and the handle member 108 will not rotate.

Eight first rod members 134*a* to 134*h* are fixed to the rotation shaft 132. Each first rod member 134*a* to 134*h* extends in a perpendicular direction with respect to the rotation shaft 132. Six of the first rod members 134*a*-134*f* on the left side are constructed so as to become longer from the interior return opening 120*b* to the interior feed opening 120*a*. The two first rod members 134*g*, 134*h* on the right side are constructed to be shorter than the first rod member 134*a*. Two adjacent first rod members (e.g., 134*a* and 134*b*) are located across a gap having a certain size. However, the gap between the first rod member 134*f* and the first rod member 134*g* is extremely small.

The second rod member 135*a* is connected to the tips of the six first rod members 134*a* to 134*f* on the left side. In addition, the second rod member 135*b* is connected to the tip of the two first rod members 134*g*, 134*h* on the right. Each area surrounded by the first rod members 134*a* to 134*h* and the second rod members 135*a*, 135*b* (e.g., the area surrounded by 134*a*, 134*b*, and 135*b*) are not closed, and are open. The film 136 that extends in the direction perpendicular to the rotation shaft 132 is bonded to the second rod member 135*b*. The film 136 has a length that contacts the inner surface of the interior member 120. The film 136 is not bonded to the second rod member 135*a*.

The transmitting member 110 is fixed to the left end of the rotation shaft 132. The transmitting member 110 is rotatably fitted into the case 102. The transmitting member 110 is exposed on the end surface on the tapered side of the case 102 (see FIG. 3). In the state in which the toner cartridge 100 is housed inside the second case 46, a drive member 49*a* described below will be engaged with the transmitting member 110. Rotational force will be input from the drive member 49*a* to the transmitting member 110. When the transmitting member 110 rotates, the rotation shaft 132 will rotate. At this point, the case 102 and the interior member 120 will not rotate.

When the rotation shaft 132 rotates, the first rod members 134*a* to 134*h*, the second rod members 135*a*, 135*b*, and the film 136 rotate together with each other. Each member 134*a* to 134*h*, 135*a*, 135*b* and film 136 transfer force in the rotational direction to the toner inside the toner chamber 104. However, force will not be applied in the direction of the rotation shaft 132. By rotating the agitator 130, the toner inside the toner chamber 104 will be stirred. The film 136 will transfer an extremely large force to the toner. Because of this, toner can be pushed out toward the interior feed opening 120*a*. In contrast, the portions to which the film 136 is not bonded (e.g., the portion adjacent to the interior return opening 120*b*) will transfer a small force to the toner. Because of this, almost no toner adjacent to the interior return opening 120*b* will be pushed out toward the interior return opening 120*b*.

(Description of the Position of the Toner Cartridge)

In the state shown in FIG. 4, the toner cartridge 100 is maintained in the state shown in FIG. 3. In other words, the bottom surface 104*a* of the toner chamber 104 slants downward from the case return opening 102*b* (the interior return opening 120*b*) to the case feed opening 102*a* (the interior feed opening 120*a*). In addition, in the state shown in FIG. 4, the front end of the toner cartridge (the lower end in FIG. 4) extends straight in the horizontal direction. In other words, the front end of the case 102 is in contact with the side wall 47 that extends straight in the horizontal direction. In this state, the axis line of the case 102 (the rotation shaft 132) extends slightly upward and to the right in FIG. 4.

Next, the detailed construction of the interior of the developing device 40 will be described with reference again to FIG. 4.

(Detailed Construction of the Interior of the Developing Device)

A side wall member 49 is fixed to the left end portion of the second case 46. The side wall member 49 rotatably supports the drive member 49*a*. The drive member 49*a* is connected to a drive source not shown in the drawings. When the drive source operates, the drive member 49*a* will rotate. In this way, the transmitting member 110 that is engaged with the drive member 49*a* will rotate.

The auger 52 has a rotation shaft 52*a*, and a spiral member 52*b* that extends in a spiral shape along the rotation shaft 52*a*. The rotation shaft 52*a* is rotatably supported on the first case 44. The spiral member 52*b* transmits force in the direction of the rotation shaft 52*a* (more specifically, in the direction of arrow S2) to toner inside the developing chamber 48.

The rotation shaft 54*a* of the developing roller 54 is rotatably supported on the first case 44. A gear 140 is fixed to the left end portion of the rotation shaft 54*a*. A gear is not provided on the right end portion of the rotation shaft 54*a*. The gear 140 meshes with a drive gear 142*a*. The drive gear 142*a* is rotatably supported on the first case 44. Drive force is input from a drive source not shown in the drawings to the drive gear 142*a*. The supply roller 50 has a rotation shaft not shown in the drawings. This rotation shaft is rotatably supported on the first case 44. A gear (not shown in the drawings) is fixed to the left end portion of the rotation shaft. This gear meshes with the drive gear 142*a*. A gear 142*b* is fixed to the right end portion of the rotation shaft of the supply roller 50. The gear 142*b* meshes with a gear (not shown in the drawings) that is fixed to the rotation shaft of the auger 52.

When rotational force is input to the drive gear 142*a*, the gear 140 of the developing roller 54, and the gear (not shown in the drawings) on the left side of the supply roller 50, will rotate. In this way, the developing roller 54 and the supply roller 50 will rotate in the same direction. When the supply roller 50 rotates, the gear of the auger 52 meshed with the gear 142*b* on the right side of the supply roller 50 will rotate. In this way, the auger 52 will rotate in the opposite direction of the supply roller 50. In the present embodiment, the supply roller 50, the auger 52, and the developing roller 54 will all be rotated by means of one drive source.

The side wall feed opening 46*a* and the side wall return opening 46*b* are formed in the side wall 47. The side wall feed opening 46*a* has the same shape as the case feed opening 102*a*. The side wall return opening 46*b* has the same shape as the case return opening 102*b*. The side wall feed opening 46*a* and the side wall return opening 46*b* are offset in the horizontal direction of FIG. 4. The side wall feed opening 46*a* and the side wall return opening 46*b* are located at the same height (the same location in the direction perpendicular to the plane of FIG. 4).

In the state shown in FIG. 4, the side wall feed opening 46*a*, the case feed opening 102*a*, and the interior feed opening 120*a*, face each other. The toner chamber 104 and the developing chamber 48 communicate with each other by means of these openings 46*a*, 102*a*, and 120*a*. Toner inside the toner chamber 104 can pass through the interior feed opening 120*a*, the case feed opening 102*a*, and the side wall feed opening 46*a*, and can move toward the developing chamber 48 (arrow S1).

In addition, in the state shown in FIG. 4, the side wall return opening 46*b*, the case return opening 102*b*, and the interior return opening 120*b*, face each other. The toner chamber 104 and the developing chamber 48 communicate with each other by means of these openings 46*b*, 102*b*, and 120*b*. Toner inside the developing chamber 48 can pass through the side wall return opening 46*b*, the case return opening 102*b*, and the interior return opening 120*b*, and can move toward the toner chamber 104 (arrow S3).

The construction of the facsimile device 10 and the toner cartridge 100 of the present embodiment was described in detail. Next, the operation of the present embodiment will be described.

Operation of the Present Embodiment

Figure 5:
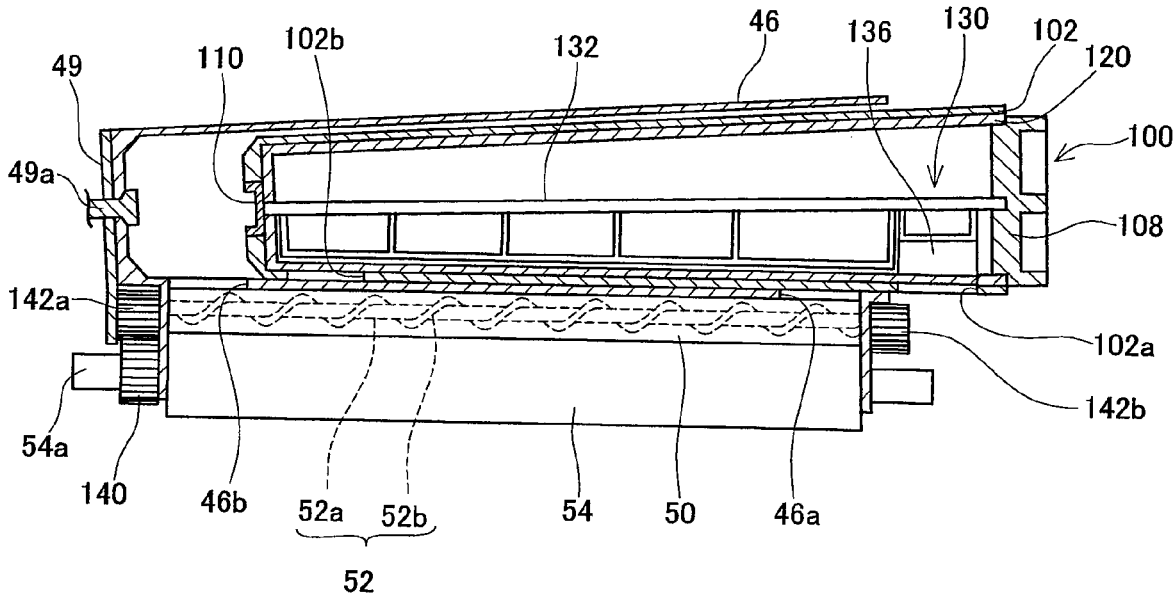
FIG. 5 shows the toner cartridge having been moved from the state shown in FIG. 4.

A user can open the lid 16 (see FIG. 1). When in this state, the toner cartridge 100 can be detached from the facsimile device 10. A user can replace a toner cartridge 100 that no longer contains any toner with a new toner cartridge 100. When the toner cartridge 100 is not attached to the facsimile device 10, the interior member 120 will be maintained in a state in which it is rotated with respect to the case 102 from the state shown in FIG. 4. In other words, the case feed opening 102*a* and the case return opening 102*b* are maintained in the closed state by means of the interior member 120. Note that each case opening 102*a*, 102*b* is shown in FIG. 5 in a state in which they are closed by the interior member 120. FIG. 5 shows a state in which the toner cartridge 100 is slightly pulled out from the state shown in FIG. 4.

A user will insert the toner cartridge 100 in the horizontal direction from the right end surface of the facsimile device 10 into the opening 14*a*. In this way, the toner cartridge 100 will be attached to the facsimile device 10. When the toner cartridge 100 is attached to the facsimile device 10, a user can rotate the handle member 108. A user will rotate the interior member 120 until the case feed opening 102*a* faces the interior feed opening 120*a*, and the case return opening 102*b* faces the interior return opening 120*b*. In this way, the case feed opening 102*a* and the case return opening 102*b* will be opened. The toner chamber 104 will communicate with the developing chamber 48.

The facsimile device 10 will send a print medium from the paper supply device 20 toward the photoreceptor 60 when a FAX communication is received. At the same time as this, the supply roller 50, the auger 52, the developing roller 54, the photoreceptor 60, the transfer roller 64, and the like will rotate. In addition, the facsimile device 10 will rotate the agitator 130 of the toner cartridge 100. In this state, the film 136 of the agitator 130 will push toner out of the interior feed opening 120*a*. In this way, toner inside the toner chamber 104 will pass through the interior feed opening 120*a*, the case feed opening 102*a*, and the side wall feed opening 46*a*, and will be fed to the developing chamber 48 (arrow S1 of FIG. 4). The developing chamber 48 will be filled with toner.

Toner inside the developing chamber 48 will be sent in the direction of arrow S2 in FIG. 4 along the supply roller 50 by means of the auger 52. In this process, toner inside the developing chamber 48 will adhere to the supply roller 50. The supply roller 50 will supply the toner supported thereon to the developing roller 54. The developing roller 54 will support toner supplied from the supply roller 50.

The toner adjacent to the side wall return opening 46*b* will be pushed out of the side wall return opening 46*b* by means of the pressure on the toner transported from the side wall feed opening 46*a*. In this way, toner inside the developing chamber 48 will pass through the side wall return opening 46*b*, the case return opening 102*b*, and the interior return opening 120*b*, and will return to the toner chamber 104 (arrow S3). At this point, the agitator 130 adjacent to the interior return opening 120*b* will push back almost no toner that is being returned. This is because the film 136 is not provided there. Toner inside the developing chamber 48 can be smoothly moved in the direction of the arrow S3 in FIG. 4.

The bottom surface 104*a* of the toner chamber 104 slants downward from the case return opening 102*b* (the interior return opening 120*b*) to the case feed opening 102*a* (the interior feed opening 120*a*) (see FIG. 3). Toner inside the toner chamber 104 will be stirred by the agitator 130, while being transported toward the case feed opening 102*a* along the slanted bottom surface 104*a* (arrow S4 in FIG. 4). Because the bottom surface 104*a* is slanted, toner inside the toner chamber 104 will be smoothly transported. The transported toner will be again fed to the developing chamber 48 in the direction of arrow S1.

As is clear from the foregoing, the toner will circulate between the toner cartridge 100 and the developing device 40 (the facsimile device 10) in the present embodiment. The exposure process and the developing process described below will be performed while the toner is circulating.

The exposure device 70 will expose the photoreceptor 60 with a predetermined pattern based upon the content to be printed (the content received during FAX communication). In this way, an electrostatic latent image will be formed on the surface of the photoreceptor 60. Toner will be supplied from the developing roller 54 to the photoreceptor 60. In this way, the electrostatic latent image formed on the surface of the photoreceptor 60 will be developed.

When a print medium passes between the photoreceptor 60 and the transfer roller 64 (when in the state shown by arrow D2 of FIG. 2), a bias will be applied to the transfer roller 64. In this way, the toner will be transferred from the photoreceptor 60 to the print medium. The print medium to which the toner was transferred will be heated by the toner fixing device 80. In this way, the toner transferred to the print media will be fixed by means of heat. Thereafter, the print medium will be discharged to the exterior of the casing 12. Text and/or images will be printed on the print medium based upon the content received during FAX communication by means of each of the aforementioned processes.

The construction and operation of the facsimile device 10 of the present embodiment was described in detail. According to the present embodiment, toner will circulate between the toner cartridge 100 and the developing device 40 (the facsimile device 10) during development of an electrostatic latent image on the photoreceptor 60. Because of this, toner that has deteriorated in quality will be mixed together with new toner. Toner that is a uniform mixture of new toner and toner that has deteriorated in quality will be adhered to the supply roller 50. Because a uniform mixture of this toner is used for development, the entire surface of the photoreceptor 60 can be developed with toner having a uniform electrostatic charge. Because of this, optimal printing results having no image density irregularities can be obtained.

The bottom surface 104*a* of the toner chamber 104 of the toner cartridge 100 is slanted downward toward the case feed opening 102*a*. Because of this, the toner inside the toner chamber 104 can be smoothly transported from the case return opening 102*b* to the case feed opening 102*a*. The toner cartridge 100 of the present embodiment transports toner inside the toner chamber 104 with excellent efficiency. When the toner cartridge 100 of the present embodiment is used, toner can be smoothly circulated between the toner cartridge 100 and the developing device 40.

By forming the toner chamber 104 in a circular truncated conical shape, the slanted configuration of the bottom surface 104*a* is achieved. Compared to a toner chamber formed into a polygon shape, the toner chamber 104 having a circular truncated conical shape allows the toner inside the toner chamber 104 to be easily stirred by the agitator 130. The toner can be uniformly stirred. In addition, when the toner chamber 104 is formed into a circular truncated conical shape, it can be assumed that the toner will be more smoothly transported.

Together with forming the toner chamber 104 in a circular truncated conical shape, the interior member 120 and the case 102 are also formed in a circular truncated conical shape. Because of that, the case feed opening 102*a* and the case return opening 102*b* can be easily opened and closed by rotating the interior member 120 with respect to the case 102. In addition, because the external appearance of the toner cartridge 100 is a circular truncated conical shape, it will be difficult to make a mistake when attaching the toner cartridge 100 to the facsimile device 10. The toner cartridge 100 that is easy for a user to handle is achieved.

The toner cartridge 100 has the interior member 120. The toner cartridge 100 (the case feed opening 102*a* and the case return opening 102*b*) can be closed when not attached to the facsimile device 10. The opening and closing of the two openings 102*a*, 102*b* is achieved by means of one member 120. According to the present embodiment, the number of parts needed to construct the toner cartridge 100 can be reduced.

Second Embodiment

Figure 6:
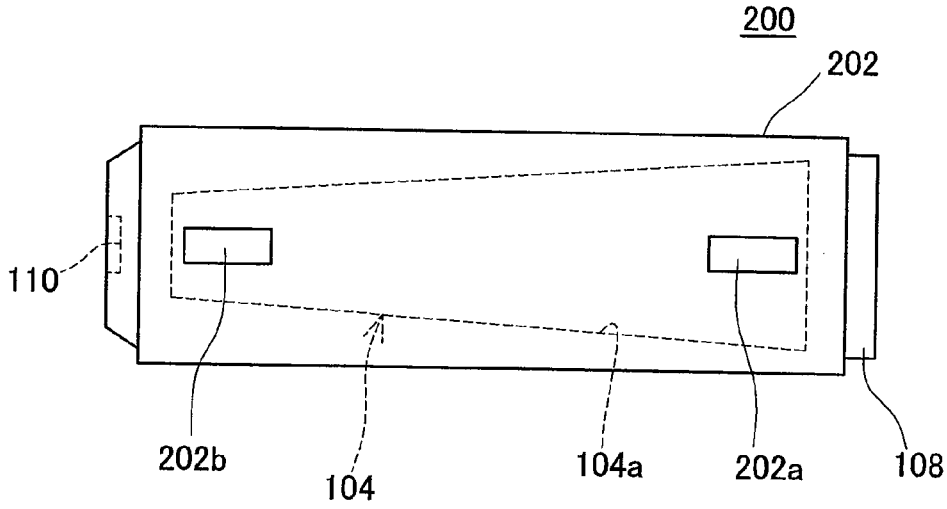
FIG. 6 shows a front view of a second embodiment of a toner cartridge.

FIG. 6 shows a front view of a toner cartridge 200 of the second embodiment. The toner cartridge 200 has a cylindrically shaped case 202. The toner chamber 104 has a substantially circular truncated conical shape that is identical to the first embodiment. Although not shown in the drawings, the space SP of the facsimile device 10 (see FIG. 2) has a columnar shape that corresponds to the exterior shape of the case 202. The toner cartridge 200 is detachably attached to the facsimile device 10 in the state shown in FIG. 6 (a state in which the axis line of the case 202 extends in the horizontal direction). In this state, the bottom surface 104*a* of the toner chamber 104 slants downward from a case return opening 202*b* to a case feed opening 202*a*.

According to the present embodiment as well, the toner inside the toner chamber 104 can be smoothly transported from the case return opening 202*b* to the case feed opening 202*a*. The toner cartridge 200 of the present embodiment transports toner inside the toner chamber 104 with excellent efficiency. In addition, when the toner cartridge 200 of the present embodiment is used, the space SP of the facsimile device 10 can be formed in a columnar shape. Here, the shape of the space SP can be made simple, and the interior construction of the facsimile device 10 can be simplified.

Third Embodiment

Figure 7:
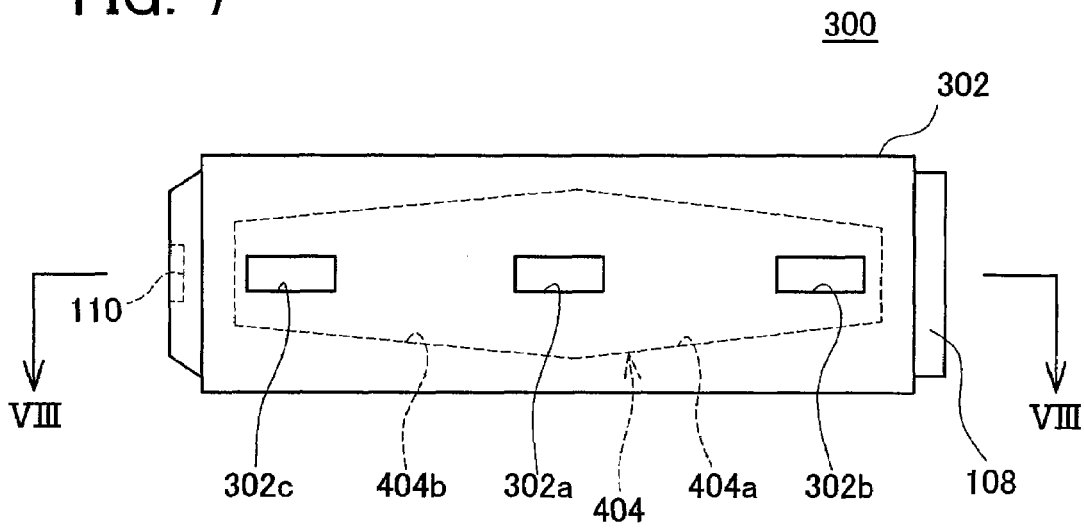
FIG. 7 shows a front view of a third embodiment of a toner cartridge.

FIG. 7 shows a front view of a toner cartridge 300 of the third embodiment. The toner cartridge 300 has a cylindrically shaped case 302. The case 302 has three case openings 302*a* to 302*c*. Each case opening 302*a* to 302*c* is formed in the same shape. The case feed opening 302*a*, the case return opening 302*b*, and the case return opening 302*c* are mutually offset in the horizontal direction of FIG. 7. The case feed opening 302*a* is located between the case return openings 302*b*, 302*c* in the horizontal direction. Each opening 302*a* to 302*c* is located at the same height.

The right and left regions of the toner chamber 404 respectively have a substantially circular truncated conical shape. The toner chamber 404 is thickest in the central portion thereof, and tapers toward both ends thereof. A bottom surface 404*a* on the right side of the toner chamber 404 slants downward from the case return opening 302*b* to the case feed opening 302*a*. A bottom surface 404*b* on the left side of the toner chamber 404 slants downward from the case return opening 302*c* to the case feed opening 302*a*.

Figure 8:
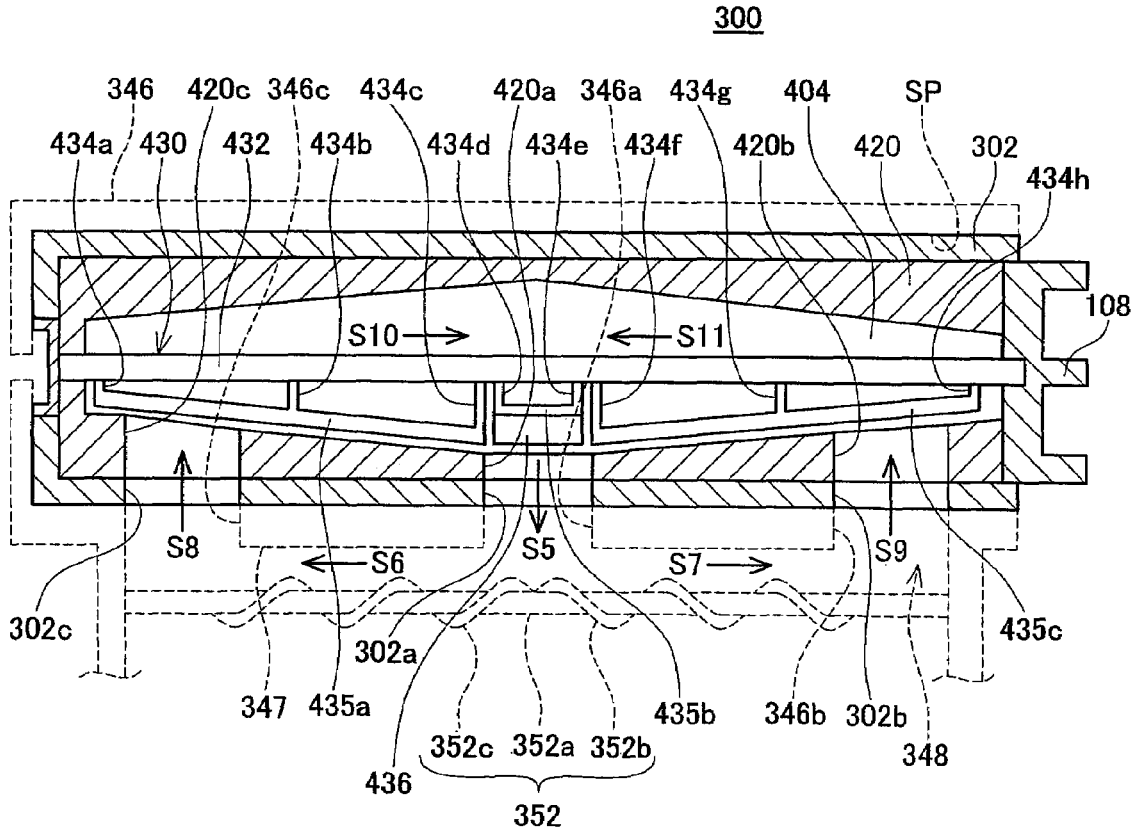
FIG. 8 shows a cross-section along line VIII-VIII of FIG. 7.

FIG. 8 shows a cross-section along line VIII-VIII of FIG. 7. As shown in FIG. 8, a second case 346 (corresponding to the second case 46 of the first embodiment) has a space SP that is substantially columnar in shape. The toner cartridge 300 is housed in this space SP. The toner cartridge 300 is detachably attached to the facsimile device 10 in the state shown in FIG. 7 (a state in which the axis line of the case 302 extends in the horizontal direction). In this state, the bottom surface 404*a* of the toner chamber 404 (see FIG. 7) slants downward from the case return opening 302*b* to the case feed opening 302*a*. In addition, the bottom surface 404*b* of the toner chamber 404 slants downward from the case return opening 302*c* to the case feed opening 302*a*.

The toner cartridge 300 includes an interior member 420. The interior member 420 is rotatably housed inside the case 302, and the external appearance of the interior member 420 is substantially columnar in shape. The interior member 420 defines the toner chamber 404. The interior member 420 has three interior openings 420*a*, 420*b*, and 420*c*. Each interior opening 420*a* to 420*c* is formed in the same shape. Each interior opening 420*a* to 420*c* and each case opening 302*a* to 302*c* has the same shape.

The interior feed opening 420*a*, the interior return opening 420*b*, and the interior return opening 420*c* are mutually offset in the horizontal direction of FIG. 8. The interior feed opening 420*a* is located between the interior return openings 420*b*, 420*c* in the horizontal direction. In the state shown in FIG. 8, the interior feed opening 420*a* faces the case feed opening 302*a*. The interior return opening 420*b* faces the case return opening 302*b*. The interior return opening 420*c* faces the case return opening 302*c*. When the cylindrical member 420 is rotated with respect to the case 302, the point at which each case opening 302*a* to 302*c* opens and closes is identical to the first embodiment.

An agitator 430 has a rotation shaft 432, first rod members 434*a* to 434*h*, second rod members 435*a* to 435*c*, and a film 436. Each first rod member 434*a* to 434*h* extends in a perpendicular direction with respect to the rotation shaft 432. The three first rod members 434*a* to 434*c* on the left side are constructed so as to become longer toward the center. The three first rod members 434*f* to 434*h* on the right side are also constructed so as to become longer toward the center. The two first rod members 434*d*, 434*e* in the center are the same length, and are formed to be short. The second rod member 435*a* is connected to the tips of the three rods 434*a* to 434*c* on the left side. The second rod member 435*b* is connected to the tips of the two first rod members 434*d*, 434*e* in the center. The second rod member 435*c* is connected to the tips of the three first rod members 434*f* to 434*h* on the right side. The film 436 is bonded to the second rod member 435*b*. Film is not bonded to the other second rod members 435*a*, 435*c*.

The second case 346 has a side wall 347 that divides the space SP from the developing chamber 348. Three side wall openings 346*a*, 346*b*, 346*c* are formed in the side wall 347. Each side wall opening 346*a* to 346*c* is formed in the same shape. Each side wall opening 346*a* to 346*c* and each case opening 302*a* to 302*c* has the same shape. The side wall feed opening 346*a*, the side wall return opening 346*b*, and the side wall return opening 346*c* are mutually offset in the horizontal direction of FIG. 8. The side wall feed opening 346*a* is located between the side wall return openings 346*b*, 346*c* in the horizontal direction. In the state shown in FIG. 8, the side wall feed opening 346*a* faces the case feed opening 302*a*. The side wall return opening 346*b* faces the case return opening 302*b*. The side wall return opening 346*c* faces the case return opening 302*c*.

An auger 352 has a rotation shaft 352*a*, and spiral members 352*b*, 352*c*. The spiral member 352*b* on the left side and the spiral member 352*c* on the left side are formed to be horizontally symmetrical.

When the agitator 430 and the auger 352 rotate, the following events will occur. The film 436 will push toner out toward the interior feed opening 420*a*. In this way, toner inside the toner storage chamber 404 will pass through the interior feed opening 420*a*, the case feed opening 302*a*, and the side wall feed opening 346*a*, and will be fed to the developing chamber 348 (arrow S5).

The toner inside the developing chamber 348 will be sent in the direction of arrow S6 by means of the left half of the auger 352. In other words, toner will be transported from the side wall feed opening 346*a* to the side wall return opening 346*c*. In addition, toner inside the developing chamber 348 will be sent in the direction of arrow S7 by means of the right half of the auger 352. In other words, toner will be transported from the side wall feed opening 346*a* to the side wall return opening 346*b*.

Toner adjacent to the side wall return opening 346 will be pushed out toward the side wall return opening 346*c*. In this way, toner inside the developing chamber 348 will pass through the side wall return opening 346*c*, the case return opening 302*c*, and the interior return opening 420*c*, and will return to the toner chamber 404 (arrow S8).

In addition, toner adjacent to the side wall return opening 346*b* will be pushed out toward the side wall return opening 346*b*. In this way, toner inside the developing chamber 348 will pass through the side wall return opening 346*b*, the case return opening 302*b*, and the interior return opening 420*b*, and will return to the toner chamber 404 (arrow S9).

Toner sent in the direction of arrow S8 will be transported in the direction (arrow S10) of the interior feed opening 420*a* (the case feed opening 302*a*) along the slant of the bottom surface 404*b* (see FIG. 7). In addition, toner sent in the direction of arrow S9 will be transported in the direction (arrow S11) of the interior feed opening 420*a* (the case feed opening 302*a*) along the slant of the bottom surface 404*c* (see FIG. 7). Because the bottom surface 404*a*, 404*b* is slanted, toner inside the toner storage chamber 404 will be smoothly transported in the S10 and S11 directions. Toner transported in the direction of arrows S10 and S11 will be again fed to the developing chamber 348.

According to the present embodiment as well, toner inside the toner storage chamber 404 can be smoothly transported. The toner cartridge 300 of the present embodiment transports toner inside the toner chamber 404 with excellent efficiency. In addition, in the present embodiment, there are two pathways for the toner to return from the developing chamber 348 to the toner chamber 404. Thus, it can be assumed that toner can be more smoothly circulated.

Specific examples of the present invention have been described in detail above, but these are simply illustrations, and do not limit the scope of the claims. In the technology disclosed within the scope of the claims, the specific examples illustrated above can be modified and changed in various ways. Modifications of the embodiments will be illustrated below.

(1) In the first embodiment, the bottom surface 104*a* of the toner chamber 104 slants downward at a constant gradient from the case return opening 102*b* to the case feed opening 102*a*. The gradient of the bottom surface 104*a* need not be constant. For example, the gradient adjacent to the case return opening 102*b* can be made steep, and the gradient adjacent to the case feed opening 102*a* can be made shallow. The reverse is also possible. In another example, the gradient need not be provided on the portion of the bottom surface 104*a* between the case return opening 102*b* and the case feed opening 102*a*. For example, a construction is possible in which there is a gradient adjacent to the case return opening 102*b*, flat at a predetermined distance therefrom, and again a gradient adjacent to the case feed opening 102*a*. In between the case return opening 102*b* and the case feed opening 102*a*, at least a portion of the bottom surface 104*a* can be said to be slanted downward, and the bottom surface 104*a* can be said to be slanted downward from the case return opening 102*b* to the case feed opening 102*a*.

(2) In each of the aforementioned embodiments, the case feed opening and the case return opening may have different sizes. In addition, the side wall feed opening and the side wall return opening may have different sizes.

(3) In each of the aforementioned embodiments, the facsimile device and toner cartridge are formed separately, but a facsimile device can be achieved in which the toner cartridge (i.e., the toner storage chamber) is built in. Here, the toner chamber may be detachable from other portions, or made non-detachable therefrom. For example, the toner cartridge 100 of the first embodiment may be fixed to the developing device 40 rather than being detachable from the developing device 40. Here, the developing device 40 and the toner cartridge 100 can be collectively referred to as a "developing device". In this modification, the toner cartridge 100 and the case 42 can be constructed as an integral case. In this modification, an opening for replenishing toner is preferably provided in the toner cartridge 100.

(4) In the aforementioned embodiments, the supply roller 50 is provided. However, a construction can be adopted in which the supply roller 50 is not provided. Here, toner is directly supplied from the developing chamber 48 to the developing roller 54.

(5) In the aforementioned embodiment, the developing chamber 48 is defined by the developing roller 54. However, a construction can also be adopted in which the developing roller 54 does not defined the developing chamber 48, and the supply roller 50 defines the developing chamber 48. In addition, a construction can also be adopted in which both the supply roller 50 and the developing roller 54 define the developing chamber 48.

In addition, the technological elements described in the present specification or drawings exhibit technical utility either individually or in various combinations, and are not limited to the combinations disclosed in the claims at the time of application. Furthermore, the technology illustrated in the present specification or drawings simultaneously achieve a plurality of objects, and has technical utility by achieving one of these objects.

What is claimed is:

1. A toner cartridge, comprising:

a cartridge case comprising a toner chamber, a cartridge side feed opening for feeding a toner from the toner chamber to the outside of the cartridge case, and a cartridge side return opening for returning the toner from the outside of the cartridge case to the toner chamber, wherein the cartridge side feed opening and the cartridge side return opening are offset along a horizontal direction, and a bottom surface of the toner chamber slants downward from the cartridge side return opening to the cartridge side feed opening.

2. The toner cartridge as in claim 1, wherein the toner chamber has a substantially circular truncated conical shape, the cartridge side feed opening is located at a side of the toner chamber that has a large radius, the cartridge side return opening is located at a side of the toner chamber that has a small radius, and the toner cartridge is detachably attached to an image forming device in a state where the axis line of the toner chamber extends along the horizontal direction.

3. The toner cartridge as in claim 2, wherein the exterior appearance of the cartridge case has a substantially circular truncated conical shape corresponding to the shape of the toner chamber.

4. The toner cartridge as in claim 3, wherein the exterior appearance of the cartridge case comprises one end surface, the other end surface, and a circular conically curved surface located between the one end surface and the other end surface, and the cartridge side feed opening and the cartridge side return opening are formed in the circular conically curved surface.

5. The toner cartridge as in claim 4, further comprising:

an agitator located within the toner chamber, the agitator comprising a rotational shaft extending along the axis line of the toner chamber; and a torque input member coupled with the agitator, wherein torque is to be input to the torque input member, and the torque input member is located at the one end surface or the other end surface.

6. An image forming device to which the toner cartridge as in claim 3 is detachably attached, the image forming device comprising:

a device case comprising a space for housing the toner cartridge, a developing chamber, and a side wall located between the space and the developing chamber, the side wall comprising a device side feed opening for feeding the toner from the toner cartridge to the developing chamber, and a device side return opening for returning the toner from the developing chamber to the toner cartridge;

a transportation member located within the developing chamber, wherein the transportation member transports the toner within the developing chamber from the device side feed opening to the device side return opening;

a developing roller coupled to the device case, the developing roller defining the developing chamber and being capable of supporting the toner within the developing chamber;

a photoreceptor to which the toner is supplied by the developing roller; and a transferring device that transfers the toner from the photoreceptor to a print medium, wherein the space of the device case has a substantially circular truncated conical shape corresponding to the exterior appearance of the cartridge case of the toner cartridge.

7. The toner cartridge as in claim 1, further comprising:

a member that simultaneously opens and closes the cartridge side feed opening and the cartridge side return opening.

8. The toner cartridge as in claim 1, wherein the cartridge case comprises two cartridge side return openings, and the cartridge side feed opening is located between the cartridge side return openings along the horizontal direction.

9. The toner cartridge as in claim 1, wherein the toner cartridge is detachably attached to an image forming device by inserting the toner cartridge into the image forming device from a side surface of the image forming device along the horizontal direction.

10. A developing device, comprising:

the toner cartridge as in claim 1;

a device case comprising a space for housing the toner cartridge, a developing chamber, and a side wall located between the space and the developing chamber, the side wall comprising a device side feed opening for feeding the toner from the toner cartridge to the developing chamber, and a device side return opening for returning the toner from the developing chamber to the toner cartridge;

a transportation member located within the developing chamber, wherein the transportation member transports the toner within the developing chamber from the device side feed opening to the device side return opening; and a developing roller coupled to the device case, the developing roller defining the developing chamber and being capable of supporting the toner within the developing chamber.

11. A developing device, comprising:

a device case comprising a toner chamber, a developing chamber, a feed port for feeding a toner from the toner chamber to the developing chamber, and a return port for returning the toner from the developing chamber to the toner chamber;

a transportation member located within the developing chamber, wherein the transportation member transports the toner within the developing chamber from the feed port to the return port; and a developing roller coupled to the device case, the developing roller defining the developing chamber and being capable of supporting the toner within the developing chamber, wherein the feed port and the return port are offset along a horizontal direction, and a bottom surface of the toner chamber slants downwards from the return port to the feed port.

12. A method of utilizing a toner cartridge, comprising:

attaching the toner cartridge to an image forming device, the toner cartridge comprising a cartridge side feed opening for feeding a toner from the toner cartridge to the image forming device, and a cartridge side return opening for returning the toner from the image forming device to the toner cartridge; and circulating the toner between the toner cartridge and the image forming device, wherein, during the circulating step, the cartridge side feed opening and the cartridge side return opening are offset along a horizontal direction, and a bottom surface of a toner chamber of the toner cartridge slants downward from the cartridge side return opening to the cartridge side feed opening.

* * * * *